US006591487B2

(12) United States Patent
Chang

(10) Patent No.: US 6,591,487 B2
(45) Date of Patent: Jul. 15, 2003

(54) COMPRESSING TOOL FOR COMPRESS-N-SEAL AT THE COAXIAL CONNECTOR

(76) Inventor: Chi-Fu Chang, No. 16, Alley 10, Lane 187, Sec. 1, Li-Nung St., Peito District, Taipei (TW)

( * ) Notice: Subject to any disclaimer, the term of this patent is extended or adjusted under 35 U.S.C. 154(b) by 38 days.

(21) Appl. No.: 09/836,294

(22) Filed: Apr. 18, 2001

(65) Prior Publication Data

US 2002/0174538 A1 Nov. 28, 2002

(51) Int. Cl.[7] ..... H01R 43/042

(52) U.S. Cl. ..... 29/751; 29/753; 29/758

(58) Field of Search ..... 29/748, 750, 751, 29/753, 758, 764, 869; 81/313, 355, 439, 440; 439/133, 135, 136; 72/409.14

(56) References Cited

U.S. PATENT DOCUMENTS 6,293,004 B1 * 9/2001 Holliday ..... 29/751

* cited by examiner

*Primary Examiner*—Gregory Huson
*Assistant Examiner*—Peter deVore
(74) *Attorney, Agent, or Firm*—Troxell Law Office PLLC

(57) ABSTRACT

The present invention providing a compressing tool for a joint body to compress and connect an insertion component to conjoin with the stiff-jacketed cable, includes a multistage propulsion mechanism, a replaceable molding structure situated on the axial line of the multistage propulsion mechanism and away from the multistage propulsion mechanism at an axial interval for supporting the stiff-jacketed coaxial cable, and a handle bar gradually moving along the direction of the axial line toward the surface of the molding structure through the multistage propulsion mechanism, so as to make the joint body and the insertion component conduct compression and connection between the multistage propulsion mechanism and the molding structure, and to enable one end of the coaxial connector to shrink and conjoin with the stiff-jacketed cable.

5 Claims, 6 Drawing Sheets

COMPRESSING TOOL FOR COMPRESS-N-SEAL AT THE COAXIAL CONNECTOR

BACKGROUND OF THE INVENTION

1) Field of the Invention

The present invention provides a compressing tool, more especially a tool enabling the joint body and the insertion component to conduct multistage compression and connection in compressing tool, thereby to force one end of the cable to enter into the joint body and combine the joint body with one end of the insertion component, and to compress again to make the joint body and the insertion component into a tightly pressed state and make one end of the coaxial connector shrink and conjoin with the stiff-jacketed cable.

2) Description of the Prior Art

The coaxial cable connector is well known in the art. Typically, an F-type coaxial cable connector is threaded onto a complimentary interface connector to electrically integrate the coaxial cables with various electronic devices, such as televisions, CB (Citizens Band) radios, FM (Frequency Modulation) radios, and wireless amateur radio systems into one unit.

The conventional coaxial cable includes a central conductor, a dielectric insulator covered on the central conductor, at least one layer of braided shield body disposed around the periphery of the dielectric insulator, and an outer cover shielded on top of the at least one layer of braided shield body. The conventional coaxial connector includes a joint body and an insertion component. The compressing and connection of the insertion component to the outer jacket cylinder of the joint body makes the outer jacket cylinder compress inwardly and deform to tightly conjoin with the coaxial cable. Since the soft materials of polyvinyl chloride used for the outer cover of the coaxial cable has been replaced by the stiff polyethylene materials, the free end of the polyethylene coaxial cable can not force the outer cover onto the coaxial connector to form connection through manual operation, but must be inserted to the coaxial connector by press-in tool. Then the insertion component will be compressed onto the outer jacket cylinder of the joint body by using the compressing tool to make one end of the coaxial connector shrink and conjoin with the stiff-jacketed cable. Therefore, this kind of operation requires extra cost, multiple installation tools, causes the inconvenience of carrying extra tools and needs to be improved.

In view of the shortcomings of the conventional connectors, the inventor of the present invention, based on experience gained from engagement in this field for many years and the spirit of pursuing for the best, researched enthusiastically for improvement and culminated in the development of the compressing tool of the present invention.

SUMMARY OF THE INVENTION

The primary objective of the present invention is to provide a compressing tool for compress-n-seal at the coaxial connector by enabling the joint body and the insertion component to conduct the compression and connection in the compressing tool thereby to make one end of the coaxial connector shrink and conjoin with the stiff-jacketed cable.

Another objective of the present invention is to provide a compressing tool capable of gradually moving along the axial direction toward the surface of the molding structure through the multistage propulsion mechanism. The first stage compression forces one end of the cable to enter into the joint body and combine the joint body and the insertion component. The second stage compression makes the outer jacket cylinder of the joint body and the insertion component into a tightly pressed state thereby to enable one end of the coaxial connector to shrink and conjoin with the stiff-jacketed cable.

The present invention of a compressing tool for compress-n-seal at the connector includes a multistage propulsion mechanism, a replaceable molding structure situated on the axial line of the multistage propulsion mechanism and away from the multistage propulsion mechanism at an axial interval for supporting the stiff-jacketed coaxial cable, and a handle bar gradually moving along the direction of the axial line toward the surface of the molding structure through the multistage propulsion mechanism. The multistage propulsion mechanism is controlled by the mesh control mechanism to perform multistage compressing movement. The first stage compression forces one end of the cable into the joint body and combines the joint body and the insertion component into a not tightly pressed state. The second stage compression makes the joint body and the insertion component into a tightly pressed state and enables one end of the coaxial connector to conjoin with the stiff-jacketed cable.

To enable a further understanding of the technical method used and efficiency for achieving the mentioned objectives and features of the present invention, the brief description of the drawings below is followed by the detailed description of the preferred embodiment.

DETAILED DESCRIPTION OF THE PREFERRED EMBODIMENTS

Figure 1:
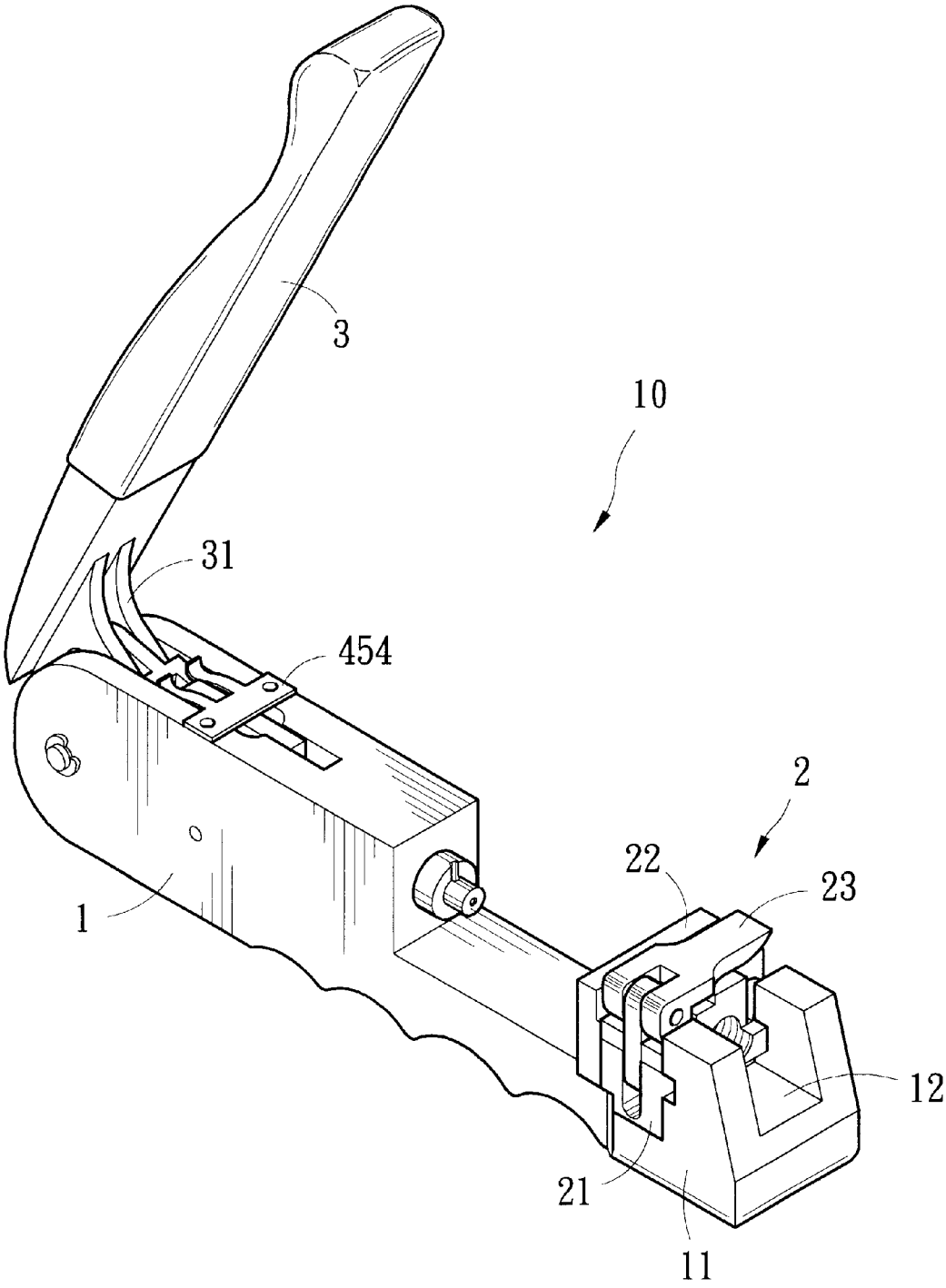
FIG. 1 is a pictorial view drawing of the present invention.
Figure 2:
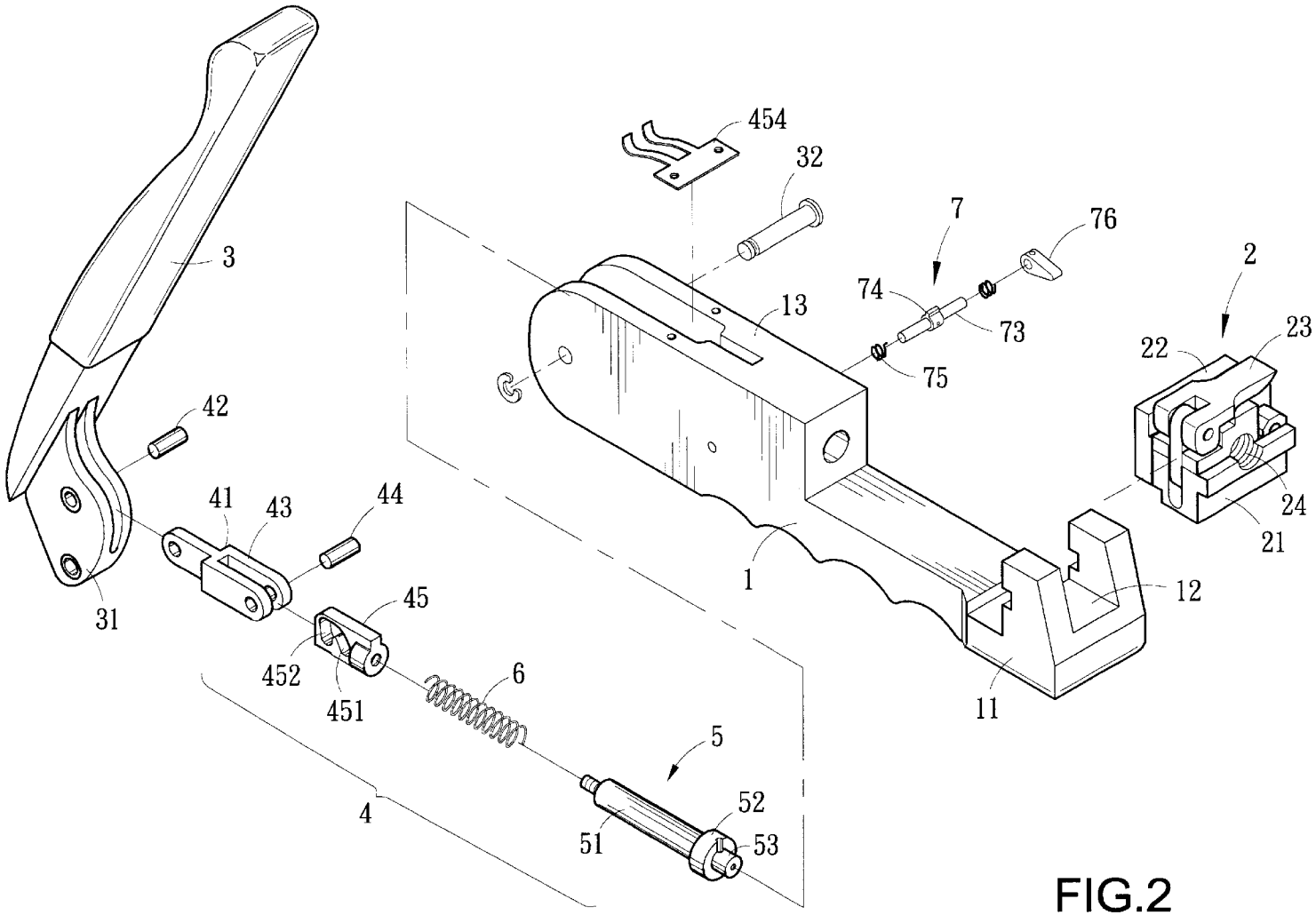
FIG. 2 is a pictorial view drawing of the disassembled present invention.
Figure 3:
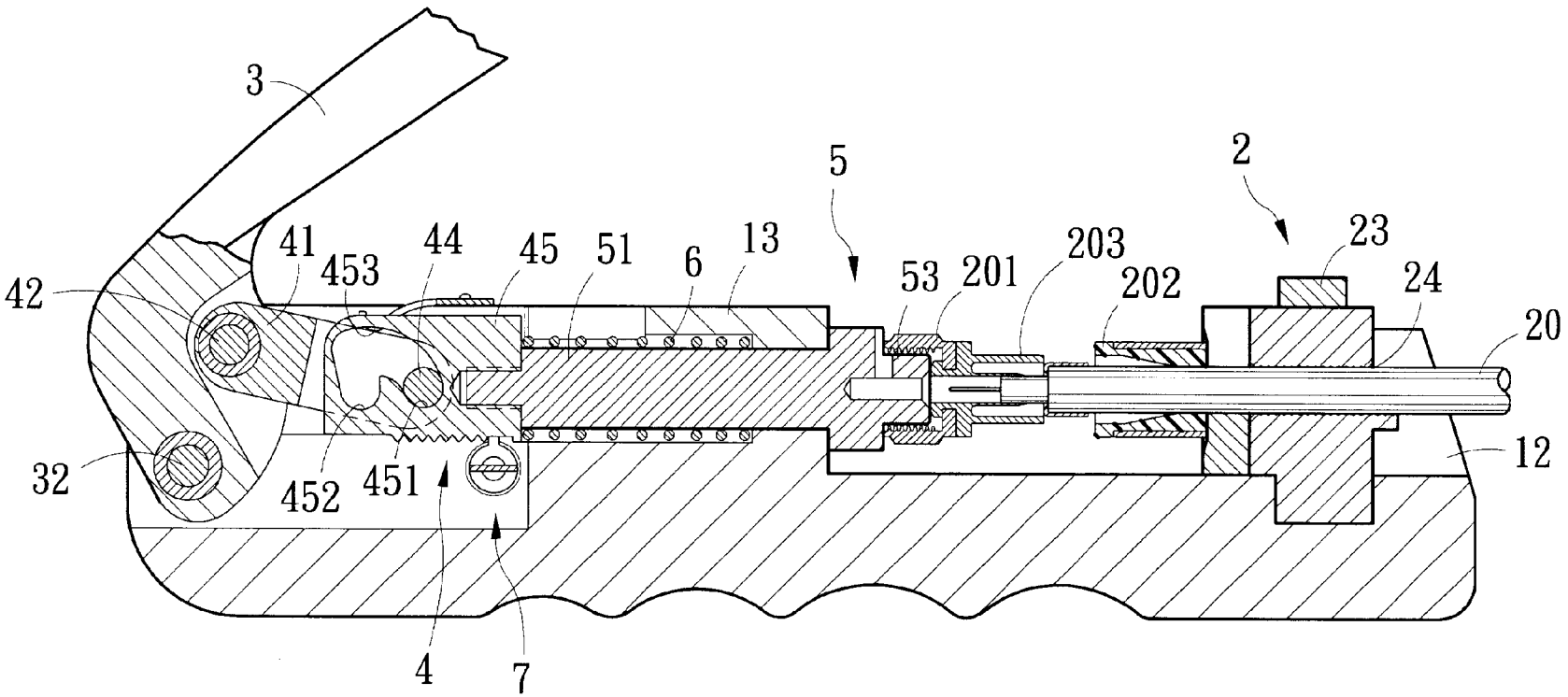
FIG. 3 is a longitudinal and cross-sectional view drawing of the present invention.

Referring from FIG. 1 to FIG. 3, the present invention is a compressing tool. The compressing tool (10) applied for connecting the stiff-jacketed cable (20) includes a machine body (1) with the molding supporting seat (11) mounted thereon, a replaceable molding structure (2) is accommodated on the molding supporting seat (11) for adapting to various specifications of the stiff-jacketed coaxial cables. The molding structure (2) comprises of two separated molding devices (21, 22) and a retaining ear structure (23). A threaded cavity (24) is formed between the two molding devices (21, 22) and leads to the opening (12). The closure of the two molding devices (21, 22) enables the threaded cavity (24) to clamp and fasten the stiff-jacketed cable (20). Since the molding structure (2) is a conventional structure, it will not be described in detail here.

A cylindrical push rod (5) of a multistage propulsion mechanism (4) can slide inside the opening of the supporting body (13). The supporting body (13) is mounted on one end of the machine body (1) and away from the molding supporting seat (11) at an axial interval. The push rod (5) situates on the axial line of the threaded cavity (24) and away from the threaded cavity (24) at an axial interval. One handle bar (3) is disposed on one end of the machine body (1) and extends outwards to form an acute angle with the machine body (1). One end (31) of the handle bar (3) is fastened onto one end of the machine body (1). The handle bar (3) is installed on the supporting body (13) by a supporting axle (32) to permit the multistage propulsion mechanism (4) centered by the supporting axle (32) to rotate and slide. The one end (31) of the handle bar (3) is connected to one end of the push shank (41) of the multistage propulsion mechanism (4). The push shank (41) is installed on one end (31) of the handle bar (3) by a supporting axle (42) and uses the supporting axle (42) as the center of rotation.

One end of the push shank (41) is formed as a forked arm (43). One push axle (44) and one push block (45) are mounted in the forked arm (43). The push axle (44) is installed on the forked arm (43). At least two channeled circularly arcuate and concaved slots (451, 452) are disposed on the push block (45). the top rim of the two circularly arcuate and concaved slots (451, 452) is a bent arcuate surface (453) inserted in the forked arm (43) to allow the push axle (44), through the exerted force, to move and change the position between the two circularly arcuate and concaved slots (451, 452) to conduct multistage pushing and moving. Part of the cross-sectional drawing of FIG. 3 shows that the push axle (44) situated in the circularly arcuate and concaved slot (451) while not making the movement of pushing and moving yet. Since the embodiment of the present invention is disposed with two circularly arcuate and concaved slots (451, 452), it only conducts two stage pushing and moving.

One end of the push block (45) connects a cylindrical push rod (5). The push rod (5) possesses a rod-shaped component (51), a center pin (53) presses against the joint body (201). A resilient component (6) (such as a spring) is coiled around the rod-shaped components (51). The resilient component (6) enables the multistage propulsion mechanism (4) to have a resuming force.

Figure 4A:
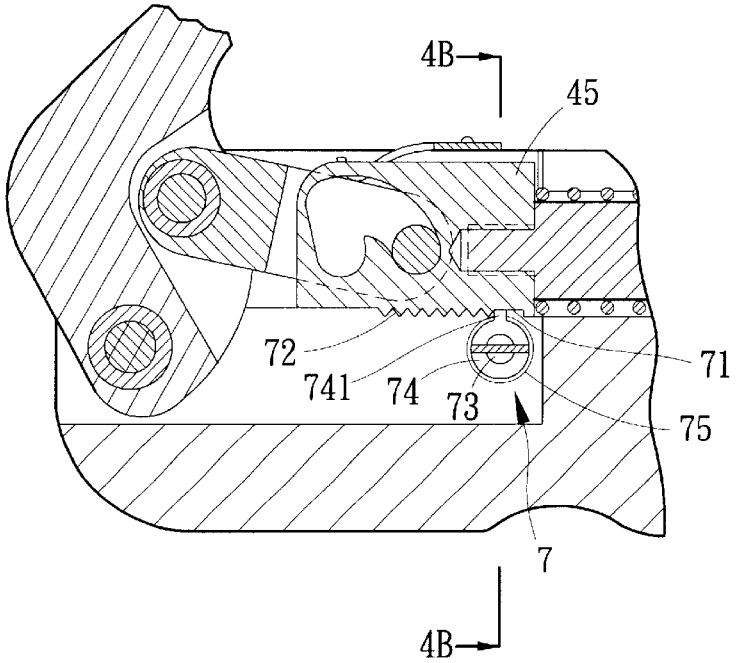
FIG. 4A is an enlarged cross-sectional view drawing of the multistage propulsion mechanism of the present invention.
Figure 4B:
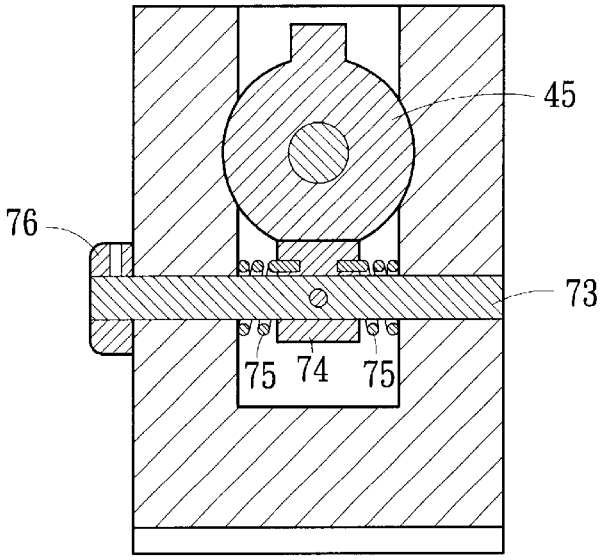
FIG. 4B is a drawing of the cross-sectional view along the 4B—4B line of FIG. 4A.

The continuous movement of the said multistage propulsion mechanism (4) is blocked by a mesh control mechanism (7). Referring to FIGS. 2, 4A and 4B, the bottom portion of the said push block (45) possesses a locating slot (71) and several gear portions (72). The mesh control mechanism (7) is installed on the machine body (1) by an axle rod (73). One turning axle (74) and two resilient components (75) (such as spring) are installed on the axle rod (73). A locating element (741) is formed on the turning axle (74) and situated inside the locating slot (71). One end of the resilient component (75) is fastened onto the locating element (741). When the push block (45) moves along the direction of the axial line to positioning, the said locating element (741) will just mesh with the gear portion (72) to prevent the push block (45) from automatically withdrawing to the starting position.

Figure 5:
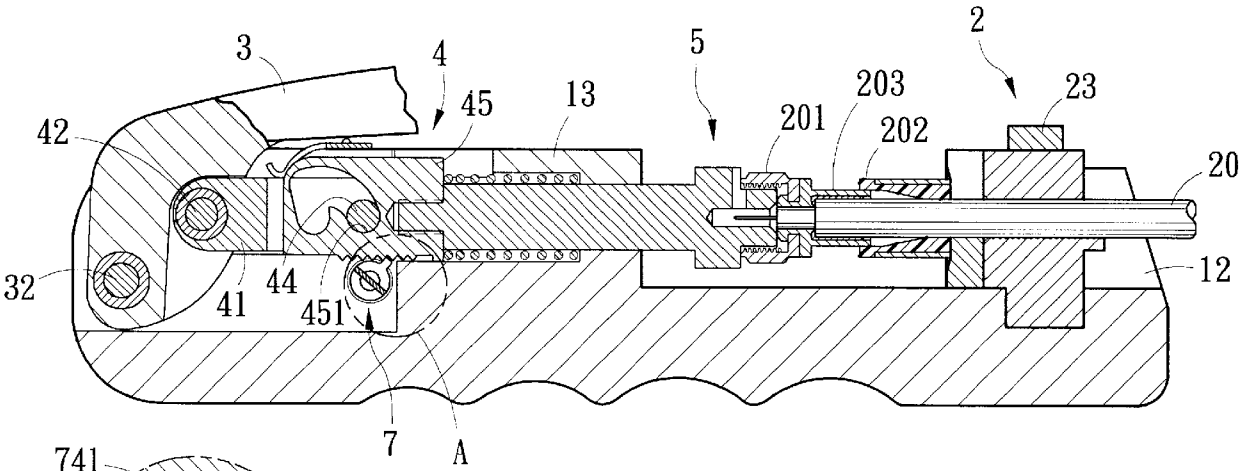
FIG. 5 is a drawing of the movement of the present invention while the handle bar being pressed downward at the first time and the push rod conducting the first stage pushing motion.

FIGS. 3 and 5 indicate the relative position and relationship among the molding structure (2), the multistage propulsion mechanism (4) and the mesh control mechanism (7) as the handle bar (3) is pushed toward the supporting body (13). This relationship has been shown clearly in FIG. 5 as one end of the stiff-jacketed cable (20) is forced into the joint body (201) while the joint body (201) combines (but not tightly compresses) an insertion component (202). The conventional coaxial connector includes a joint body (201) and an outer jacket cylinder (203). The insertion component (202) has a tapered hole formed therein. The joint body (201) further includes an outer jacket cylinder (203) made of thin and formable materials. Therefore, the connection between the joint body (201) and the insertion component (202) will cause the outer jacket cylinder (203) compress and deform inwardly into a similar tapered configuration. Before compressing, first slide the insertion component (202) into the stiff-jacket cable (20), while the joint body (201) is placed at one end of the stiff-jacketed cable (20) and then inserted through the threaded cavity (24) and the opening (12) of the molding structure (2), then retain the molding structure (2) to a closed state to clamp and fasten the stiff-jacketed cable (20) until the center pin (53) presses against the joint body (201) and moves forward.

Figure 5A:
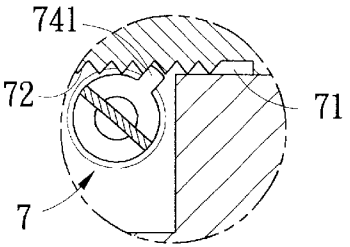
FIG. 5A is an enlarged view of area A in FIG. 5.

The handle bar (3), centered by the supporting axle (32) and being pressed downward (as shown in FIG. 5) from the opened position (as shown in FIG. 3) can make the multistage propulsion mechanism (4) centered by the supporting axle (42) push forward; the moving of the push shank (41) will make the push axle (44) slide into the circularly arcuate and concaved slot (451) and push the push block (45) inside the circularly arcuate and concaved slot (451). The push block (45) then moves the center pin (53) of the push rod (5) toward the molding structure (2) until the center pin (53) presses against the joint body (201) and moves forward. Therefore, the moving distance of the first stage compression of the push rod (5) is the pushing distance of the push axle (44) situated inside the circularly arcuate and concaved slot (451). The moving distance of the first stage compression will force one end of the cable (20) into the outer jacket cylinder (203) of the joint body (201), the joint body (201) combines the insertion component (202) but not in a tightly pressed stage. At this time, the locating element (741) of the mesh control mechanism (7) will mesh with the gear portion (72) due to the moving forward of the push block (45) to prevent the multistage propulsion mechanism (4) from withdrawing to the original position (as shown in FIG. 5A).

Figure 6:
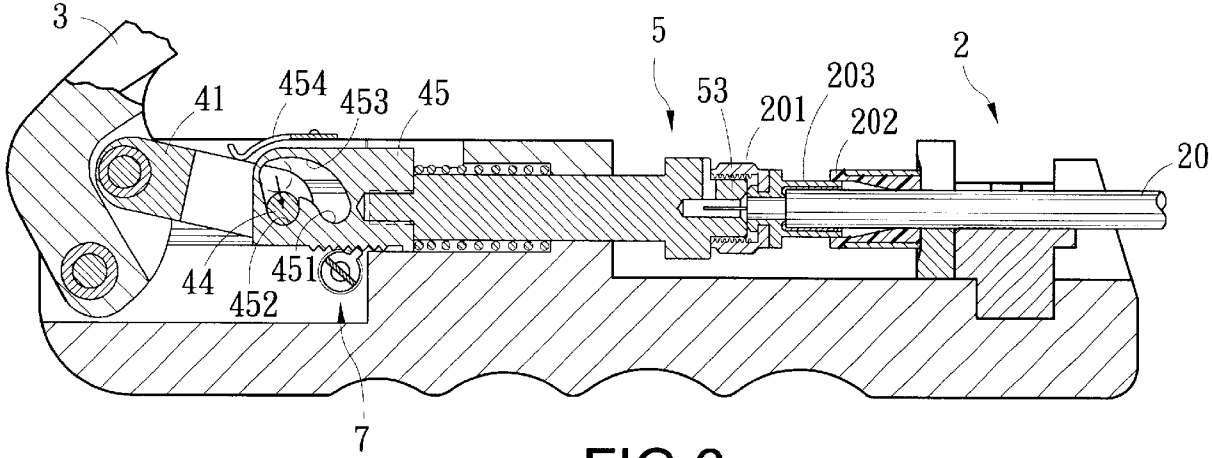
FIG. 6 is a drawing of movement of the present invention while the handle bar being wrenched upwards to prepare for the second compressing motion.

When the joint body (201) and the insertion component (202) are in a combined state (as shown in FIG. 5), the retaining ear structure (23) of the molding structure (2) needs to be opened to release the stiff-jacketed cable (20) from any pressed clamping or fastening thereby to facilitate for the next compression to make the stiff-jacketed cable (20) contract backwards. After accomplishing the compressing steps shown in FIG. 5, pull the handle bar (3) once again away from the supporting body (13) to an opened position (as shown in FIG. 6). At the mean time, the push shank (41) will move backward and allow the push axle (44), along the top surface of the bent arcuate surface (453) of the two circularly arcuate and concaved slots (451, 452), to slide from the circularly arcuate and concaved slot (451) to the circularly arcuate and concaved slot (452). The sliding force comes from the resilient force of the resilient element (454) and enables the push axle (44) to specifically drop into the circularly arcuate and concaved slot (452).

Figure 7:
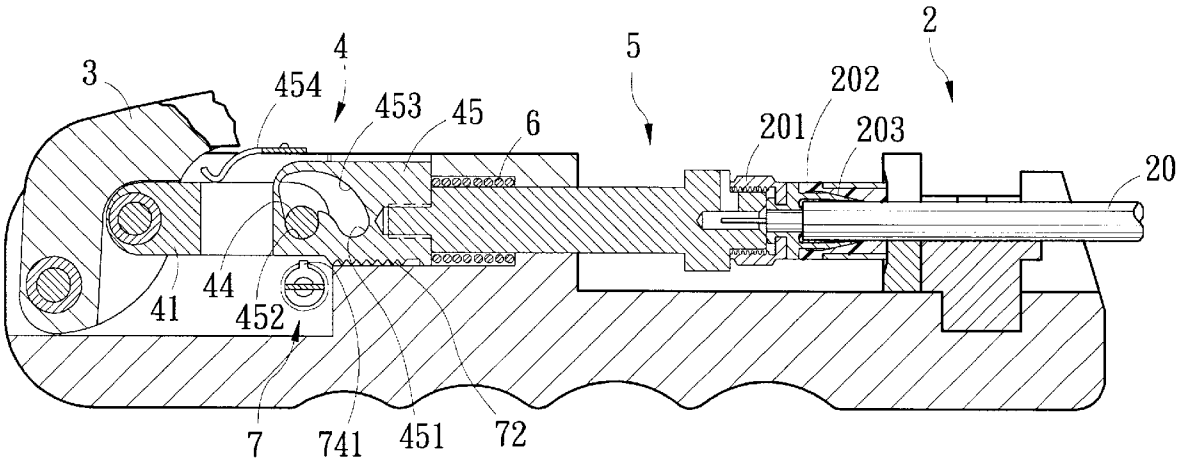
FIG. 7 is a drawing of the movement of the present invention while the handle bar being pressed downward at the second time and the push rod conducting the second stage pushing motion.

The handle bar (3) is pressed downward from the opened position as indicated in FIG. 6 to conduct the compression step of the second stage (as shown in FIG. 7). At this time, the push axle (44) is pushing the push block (45) inside the circularly arcuate and concaved slot (452) to make the center pin (53) of the push rod (5) press against the joint body (201) and conduct the compression. Therefore, the push rod (5) uses the pushing distance of the push axle (44) situated inside the circularly arcuate and concaved slot (452) as the compression distance of the second stage for compressing the joint body (201) and the insertion component (202). The moving distance of the second stage will tightly compress and connect the outer jacket cylinder (203) of the joint body (201) and the insertion component (202), and make one end of the coaxial connector shrink and conjoin with the stiff-jacketed cable (20) (as shown in FIG. 7). At the mean time, the locating element (741) of the mesh control mechanism (7) will be pushed by the push block (45) and move forward again for a certain distance to make the locating element (741) not mesh with the gear portion (72) but situate at the bottom section of the push block (45).

Since the said push block (45) is not blocked by the locating element (741), the entire multistage propulsion mechanism (4) is not under any more control, thus, through the recoiling force of the resilient component (6), the multistage propulsion mechanism (4) can resume to the original and starting position as indicated in FIG. 3.

Figure 8:
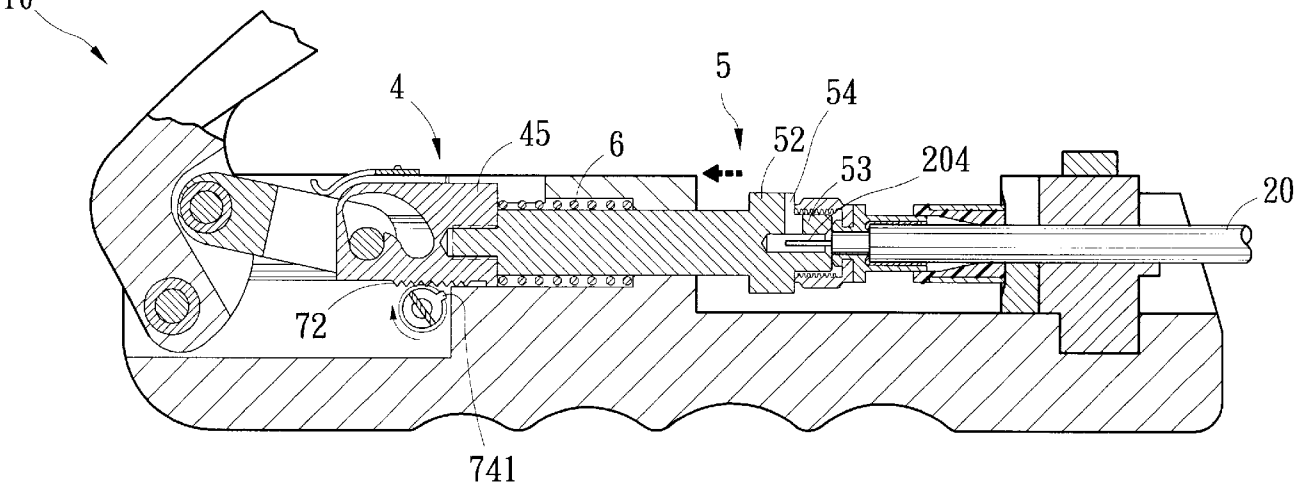
FIG. 8 is an isometric drawing of the present invention using the turning knob to resume the push rod back to the original position.

As shown in FIGS. 4B and 8, if the operation of the present invention goes wrong during the compressing procedure of the compressing component does not reach at the correct position, then the turning knob (76) will be turned to make the locating element (741) leave the gear portion (72). Therefore, the push block (45) will not be blocked by the locating element (741) and thereby release the multistage propulsion mechanism (4) from any more control, then through the recoiling force of the resilient component (6) to make the multistage propulsion mechanism (4) resume to the original and starting position as shown in FIG. 3 for conducting again the multistage shrinking and connecting.

A window (54) is mounted between the flange (52) of the push rod (5) and the center pin (53) for examining and testing whether the central conductor (204) of the stiff-jacketed cable (20) reaches the correct position. If not, the turning knob (76) can be used to resume the multistage propulsion mechanism (4) to the original and starting position as shown in FIG. 3.

In summation of the foregoing sections, the present invention uses the multistage propulsion mechanism (4) to combine one end of the cable (20) with the joint body (201), then tightly compresses and connects one end of the joint body (201) with the insertion component (202) to make one end of the coaxial connector shrink, completely seal and conjoin with the stiff-jacketed cable (20).

The forgoing illustrations and descriptions are merely for the exemplary embodiments of the present invention and are not to be construed as limiting the present invention. To those skilled in the art, any alternative or modification based on the feature scope of the present invention will be included in the following scope of the claim application of the present invention.

What is claimed is:

1. A compressing tool for connecting a coaxial connector to a stiff-jacket cable, comprising:

a) a machine body having a supporting body and a molding support seat;

b) a molding structure having two molding portions with an insertion component, the molding structure connected to the molding support seat;

c) a cylindrical push rod slidably mounted in the supporting body so as to move toward and away from the molding structure;

d) a handle pivotally attached to the supporting body so as to pivot about a supporting axle;

e) a push shank pivotally connected to the handle and including a push axle;

f) a push block attached to the cylindrical push rod and having an opening therethrough including a plurality of arcuate, concave slots and an arcuate top rim above the plurality of arcuate, concave slots, the push axle extending through the opening so as to selectively engage one of the plurality of arcuate, concave slots, such that pivoting movement of the handle causes sliding movement of the cylindrical push rod toward and away from the molding structure, the push block having a locating slot and gear teeth thereon; and, g) a mesh control mechanism in the supporting body including a locating element selectively engaging or disengaging the locating slot and ne of the gear teeth on the push block to control movement of the push block and the cylindrical push rod.

2. The compressing tool for connecting a coaxial connector to a stiff-jacket cable according to claim 1, wherein the mesh control mechanism has at least one resilient device adjoined at one end to the locating element to keep the locating element engaged with one of the gear teeth thereby preventing the cylindrical push rod from moving away from the molding structure.

3. The compressing tool for connecting a coaxial connector to a stiff-jacket cable according to claim 1, further comprising:

a resilient device positioned on an outer circumference of the cylindrical push rod between the supporting body and push block to apply a force against the supporting body and push block to move the cylindrical push rod away from the molding structure when the locating element disengages the gear teeth.

4. The compressing tool for connecting a coaxial connector to a stiff-jacket cable according to claim 3, wherein the mesh control mechanism has a turning knob for selectively engaging and disengaging the locating element with the locating slot and one of the gear teeth.

5. The compressing tool for connecting a coaxial connector to a stiff-jacket cable according to claim 1, wherein the cylindrical push rod has a window for examining and testing.

* * * * *